US009019329B2

(12) United States Patent
Zirilli et al.

(10) Patent No.: US 9,019,329 B2
(45) Date of Patent: Apr. 28, 2015

(54) SYSTEMS FOR DAMPENING FLUID REMOVAL, VAPOR CONTROL AND RECOVERY FOR INK-BASED DIGITAL PRINTING

(71) Applicant: Xerox Corporation, Norwalk, CT (US)

(72) Inventors: Francisco Zirilli, Penfield, NY (US); Palghat Ramesh, Pittsford, NY (US); Jack Lestrange, Macedon, NY (US); Peter J. Knausdorf, Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/950,731

(22) Filed: Jul. 25, 2013

(65) Prior Publication Data

US 2015/0029292 A1 Jan. 29, 2015

(51) Int. Cl.

| | |
|---|---|
| ***B41J 2/435*** | (2006.01) |
| ***B41L 23/00*** | (2006.01) |
| ***B41L 25/00*** | (2006.01) |
| ***B41J 2/44*** | (2006.01) |

(52) U.S. Cl.

CPC ..... *B41J 2/442* (2013.01)

(58) Field of Classification Search

CPC ..... B41C 1/1041; B41C 1/1008; B41F 3/30; B41F 3/32; B41F 3/34; B41F 7/04; B41F 7/24; B41F 7/26; B41N 1/003; B41N 3/08

USPC ..... 347/224, 225; 101/147, 375–377, 379, 101/395, 401, 401.1, 450.1, 453, 463.1

See application file for complete search history.

(56) References Cited

U.S. PATENT DOCUMENTS

| | | | | |
|---|---|---|---|---|
| 8,561,610 | B2 * | 10/2013 | Wachtel et al. | 128/203.15 |
| 2012/0103213 | A1 | 5/2012 | Stowe et al. | |

* cited by examiner

*Primary Examiner* — Hai C Pham

(74) *Attorney, Agent, or Firm* — Ronald E. Prass, Jr.; Prass LLP

(57) ABSTRACT

A system for dampening fluid recovery in an ink-based digital printing system includes a seal manifold having a front seal portion, the front seal portion having an upper wall facing the imaging surface, the upper wall being configured to define an air flow channel with the imaging surface, the upper wall being contoured to form a distance between the upper wall and the imaging surface at an evaporation location that is less than distance between the upper wall and the imaging surface at locations interposing the evaporation location and a vacuum inlet channel of the seal manifold.

20 Claims, 9 Drawing Sheets

SYSTEMS FOR DAMPENING FLUID REMOVAL, VAPOR CONTROL AND RECOVERY FOR INK-BASED DIGITAL PRINTING

FIELD OF DISCLOSURE

The disclosure relates to ink-based digital printing. In particular, the disclosure relates to printing variable data using an ink-based digital printing system that includes a dampening fluid removal, control, and recovery.

BACKGROUND

Conventional lithographic printing techniques cannot accommodate true high-speed variable data printing processes in which images to be printed change from impression to impression, for example, as enabled by digital printing systems. The lithography process is often relied upon, however, because it provides very high quality printing due to the quality and color gamut of the inks used. Lithographic inks are also less expensive than other inks, toners, and many other types of printing or marking materials.

Ink-based digital printing uses a variable data lithography printing system, or digital offset printing system. A "variable data lithography system" is a system that is configured for lithographic printing using lithographic inks and based on digital image data, which may be variable from one image to the next. "Variable data lithography printing," or "digital ink-based printing," or "digital offset printing" is lithographic printing of variable image data for producing images on a substrate that are changeable with each subsequent rendering of an image on the substrate in an image forming process.

For example, a digital offset printing process may include transferring radiation-curable ink onto a portion of a fluorosilicone-containing imaging member surface that has been selectively coated with a dampening fluid layer according to variable image data. The ink is then cured and transferred from the printing plate to a substrate such as paper, plastic, or metal on which an image is being printed. The same portion of the imaging plate may be cleaned and used to make a succeeding image that is different than the preceding image, based on the variable image data. Ink-based digital printing systems are variable data lithography systems configured for digital lithographic printing that may include an imaging member having a reimageable surface layer, such as a silicone-containing surface layer.

Systems may include a dampening fluid metering system for applying dampening fluid to the reimageable surface layer, and an imaging system for laser-patterning the layer of dampening fluid according to image data. The dampening fluid layer is patterned by the imaging system to form a dampening fluid pattern on a surface of the imaging member based on variable data. The imaging member is then inked to form an ink image based on the dampening fluid pattern. The ink image may be partially cured, and is transferred to a printable medium, and the imaged surface of the imaging member from which the ink image is transferred is cleaned for forming a further image that may be different than the initial image, or based on different image data than the image data used to form the first image. Such systems are disclosed in U.S. patent application Ser. No. 13/095,714 ("714 application"), titled "Variable Data Lithography System," filed on Apr. 27, 2011, by Stowe et al., which is commonly assigned, and the disclosure of which is hereby incorporated by reference herein in its entirety.

SUMMARY

Variable data lithographic printing system and process designs must overcome substantial technical challenges to enable high quality, high speed printing. For example, digital architecture printing systems for printing with lithographic inks impose stringent requirements on subsystem materials, such as the surface of the imaging plate, ink used for developing an ink image, and dampening fluid or fountain.

Fountain solution or dampening fluid such as octamethylcyclotetrasiloxane "D4" or cyclopentasiloxane "D5" may be applied to an imaging member surface such as a printing plate or blanket. Subsequently, the applied layer of dampening fluid is image-wise vaporized according to image data to form a latent image in the dampening fluid layer, which may be about 0.5 microns in thickness, for example. During the laser imaging process the base marking material layer in a uniform layer, and may spread across the background region, allowing subsequently applied ink to selectively adhere to the image region. A background region includes D4 between the plate and ink. A thickness of the dampening fluid layer is around 0.2 microns, or between 0.05 and 0.5 microns. The laser used to generate the latent image creates a localized high temperature region that is at about the boiling point of the dampening fluid, e.g., about 175° C. Accordingly, during the imaging process, large temperature gradients are formed on the imaging surface, and the surface temperature rapidly decreases to the ambient temperature away from the imaging zone, or the portion of the imaging member surface on which imaging takes place.

Due to a motion of the imaging member surface during printing, dampening fluid vapor has been found to migrate over cooler regions of the imaging member surface, allowing the vapor to re-condense on the imaging surface. If re-condensation occurs over an imaged region of the imaging member surface, streaks may appear in the printed image. Dampening fluid vapor must be removed before it re-condenses on the imaging member surface. Related art dampening fluid vacuum recovery systems are limited to low process speeds, for example, less than 500 mm/s.

A dampening fluid recovery system for ink-based digital printing is provided that enables effective removal, control, and recovery of dampening fluid during a printing process. In an embodiment, a dampening fluid recovery system is provided that includes a vacuum and a vacuum flow path. The vacuum flow path is contoured, and the contour is configured to enable an increase in flow speed without impinging on the imaging surface.

Exemplary embodiments are described herein. It is envisioned, however, that any system that incorporates features of systems described herein are encompassed by the scope and spirit of the exemplary embodiments.

DETAILED DESCRIPTION

Figure 1:
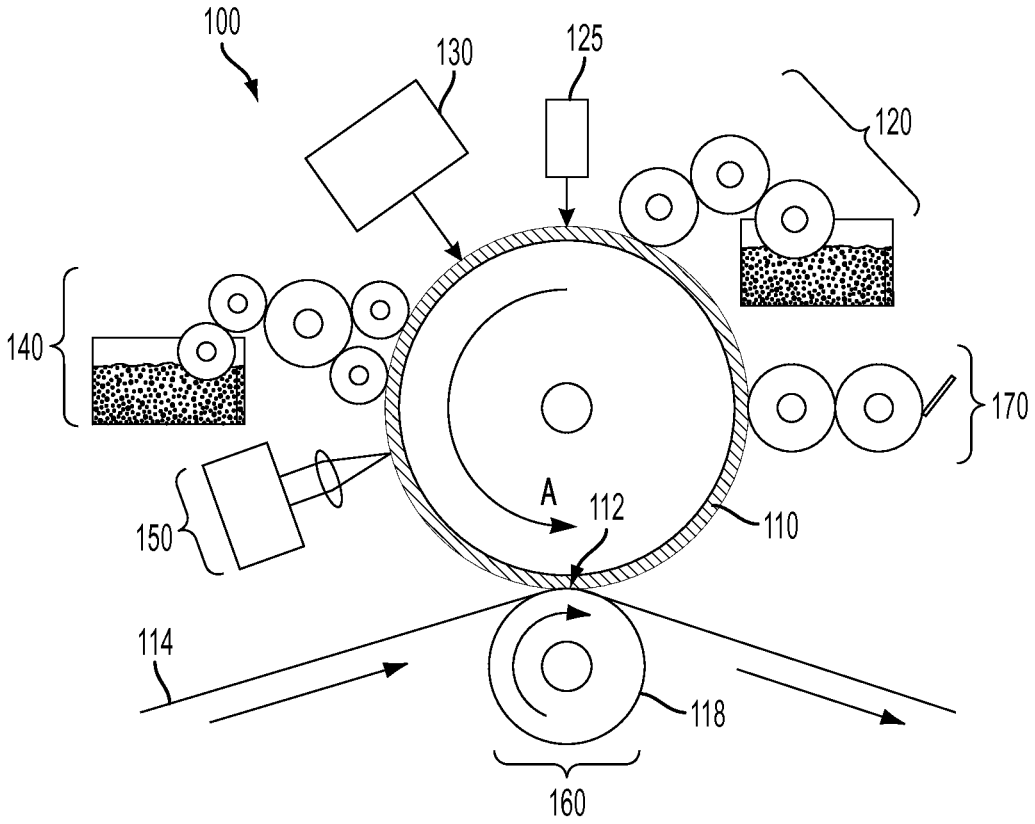
FIG. 1 RELATED ART
FIG. 1 shows a side diagrammatical view of a related art ink-based digital printing system.

Exemplary embodiments are intended to cover all alternatives, modifications, and equivalents as may be included within the spirit and scope of the apparatus and systems as described herein.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value.

Reference is made to the drawings to accommodate understanding of systems for ink-based digital printing, and ink-based digital printing system dampening fluid recovery systems. In the drawings, like reference numerals are used throughout to designate similar or identical elements. The drawings depict various embodiments of illustrative systems for removing, controlling, and recovering dampening fluid for ink-based digital printing.

It has also been found that during laser exposure, evaporated fountain solution may need to be removed immediately. Otherwise, vaporized fountain solution may re-deposit onto the plate causing image quality problems such as voids in the applied ink layer. To enable desired removal and recovery of dampening fluid from an imaging area of an imaging member surface during printing, it has been found that vacuum flow must be directed towards the imaging member surface without impinging upon the surface.

In an embodiment, dampening fluid recovery systems may include a vacuum flow path contoured to reduce a flow cross-sectional area at a vapor source location on the imaging member surface in comparison with other locations of the imaging member surface. Accordingly, recovery systems in accordance with embodiments enable ink-based digital printing while minimizing streaks in the printed image, and enhancing image quality.

In another embodiment, dampening fluid recovery systems may include a vacuum flow path contoured to reduce a flow cross-sectional area at a vapor source location on the imaging member surface. Further, systems may include a channel formed to enable low flow impedance and uniform flow distribution, wherein the channel is configured to reduce a flow cross-sectional area at the vapor source location on the imaging member surface. Accordingly, systems may be configured to print at acceptable process speeds, for example, 500 mm/sec to 2000 mm/sec. Moreover, systems may be configured to print at such speeds while running at desired process widths. For example, systems may be configured to include a 1200 DPI laser system while printing at 2000 mm/sec.

The 714 application describes an exemplary related art variable data lithography system 100 for ink-based digital printing, such as that shown, for example, in FIG. 1. A general description of the exemplary system 100 shown in FIG. 1 is provided here. Additional details regarding individual components and/or subsystems shown in the exemplary system 100 of FIG. 1 may be found in the 714 application.

As shown in FIG. 1, the exemplary system 100 may include an imaging member 110. The imaging member 110 in the embodiment shown in FIG. 1 is a drum, but this exemplary depiction should not be interpreted so as to exclude embodiments wherein the imaging member 110 includes a drum, plate or a belt, or another now known or later developed configuration. The reimageable surface may be formed of materials including, for example, a class of materials commonly referred to as silicones, including polydimethylsiloxane (PDMS), among others. The reimageable surface may be formed of a relatively thin layer over a mounting layer, a thickness of the relatively thin layer being selected to balance printing or marking performance, durability and manufacturability.

The imaging member 110 is used to apply an ink image to an image receiving media substrate 114 at a transfer nip 112. The transfer nip 112 is formed by an impression roller 118, as part of an image transfer mechanism 160, exerting pressure in the direction of the imaging member 110. Image receiving medium substrate 114 should not be considered to be limited to any particular composition such as, for example, paper, plastic, or composite sheet film. The exemplary system 100 may be used for producing images on a wide variety of image receiving media substrates. The 714 application also explains the wide latitude of marking (printing) materials that may be used, including marking materials with pigment densities greater than 10% by weight. As does the 714 application, this disclosure will use the term ink to refer to a broad range of printing or marking materials to include those which are commonly understood to be inks, pigments, and other materials which may be applied by the exemplary system 100 to produce an output image on the image receiving media substrate 114.

The 714 application depicts and describes details of the imaging member 110 including the imaging member 110 being comprised of a reimageable surface layer formed over a structural mounting layer that may be, for example, a cylindrical core, or one or more structural layers over a cylindrical core.

The exemplary system 100 includes a dampening fluid system 120 generally comprising a series of rollers, which may be considered as dampening rollers or a dampening unit, for uniformly wetting the reimageable surface of the imaging member 110 with dampening fluid. A purpose of the dampening fluid system 120 is to deliver a layer of dampening fluid, generally having a uniform and controlled thickness, to the reimageable surface of the imaging member 110. As indicated above, it is known that a dampening fluid such as fountain solution may comprise mainly water optionally with small amounts of isopropyl alcohol or ethanol added to reduce surface tension as well as to lower evaporation energy necessary to support subsequent laser patterning, as will be described in greater detail below. Small amounts of certain surfactants may be added to the fountain solution as well. Alternatively, other suitable dampening fluids may be used to enhance the performance of ink based digital lithography systems. Exemplary dampening fluids include water, NOVEC 7600 (1,1,1,2,3,3-Hexafluoro-4-(1,1,2,3,3,3-hexafluoropropoxy)pentane and has CAS#870778-34-0.), and D4 (octamethylcyclotetrasiloxane). Other suitable dampening fluids are disclosed, by way of example, in co-pending U.S. patent application Ser. No. 13/284,114, titled "Dampening Fluid For Digital Lithographic Printing," filed on Oct. 28, 2011, by Stowe, the disclosure of which is hereby incorporated herein by reference in its entirety.

Once the dampening fluid is metered onto the reimageable surface of the imaging member 110, a thickness of the dampening fluid may be measured using a sensor 125 that may provide feedback to control the metering of the dampening fluid onto the reimageable surface of the imaging member 110 by the dampening fluid system 120.

After a precise and uniform amount of dampening fluid is provided by the dampening fluid system 120 on the reimageable surface of the imaging member 110, and optical patterning subsystem 130 may be used to selectively form a latent image in the uniform dampening fluid layer by image-wise patterning the dampening fluid layer using, for example, laser energy. Typically, the dampening fluid will not absorb the optical energy (IR or visible) efficiently. The reimageable surface of the imaging member 110 should ideally absorb most of the laser energy (visible or invisible such as IR) emitted from the optical patterning subsystem 130 close to the surface to minimize energy wasted in heating the dampening fluid and to minimize lateral spreading of heat in order to maintain a high spatial resolution capability. Alternatively, an appropriate radiation sensitive component may be added to the dampening fluid to aid in the absorption of the incident radiant laser energy. While the optical patterning subsystem 130 is described above as being a laser emitter, it should be understood that a variety of different systems may be used to deliver the optical energy to pattern the dampening fluid.

The mechanics at work in the patterning process undertaken by the optical patterning subsystem 130 of the exemplary system 100 are described in detail with reference to FIG. 5 in the 714 application. Briefly, the application of optical patterning energy from the optical patterning subsystem 130 results in selective removal of portions of the layer of dampening fluid.

Following patterning of the dampening fluid layer by the optical patterning subsystem 130, the patterned layer over the reimageable surface of the imaging member 110 is presented to an inker subsystem 140. The inker subsystem 140 is used to apply a uniform layer of ink over the layer of dampening fluid and the reimageable surface layer of the imaging member 110. The inker subsystem 140 may use an anilox roller to meter an offset lithographic ink onto one or more ink forming rollers that are in contact with the reimageable surface layer of the imaging member 110. Separately, the inker subsystem 140 may include other traditional elements such as a series of metering rollers to provide a precise feed rate of ink to the reimageable surface. The inker subsystem 140 may deposit the ink to the pockets representing the imaged portions of the reimageable surface, while ink on the unformatted portions of the dampening fluid will not adhere to those portions.

The cohesiveness and viscosity of the ink residing in the reimageable layer of the imaging member 110 may be modified by a number of mechanisms. One such mechanism may involve the use of a rheology (complex viscoelastic modulus) control subsystem 150. The rheology control system 150 may form a partial crosslinking core of the ink on the reimageable surface to, for example, increase ink cohesive strength relative to the reimageable surface layer. Curing mechanisms may include optical or photo curing, heat curing, drying, or various forms of chemical curing. Cooling may be used to modify rheology as well via multiple physical cooling mechanisms, as well as via chemical cooling.

The ink is then transferred from the reimageable surface of the imaging member 110 to a substrate of image receiving medium 114 using a transfer subsystem 160. The transfer occurs as the substrate 114 is passed through a nip 112 between the imaging member 110 and an impression roller 118 such that the ink within the voids of the reimageable surface of the imaging member 110 is brought into physical contact with the substrate 114. With the adhesion of the ink having been modified by the rheology control system 150, modified adhesion of the ink causes the ink to adhere to the substrate 114 and to separate from the reimageable surface of the imaging member 110. Careful control of the temperature and pressure conditions at the transfer nip 112 may allow transfer efficiencies for the ink from the reimageable surface of the imaging member 110 to the substrate 114 to exceed 95%. While it is possible that some dampening fluid may also wet substrate 114, the volume of such a dampening fluid will be minimal, and will rapidly evaporate or be absorbed by the substrate 114.

In certain offset lithographic systems, it should be recognized that an offset roller, not shown in FIG. 1, may first receive the ink image pattern and then transfer the ink image pattern to a substrate according to a known indirect transfer method.

Following the transfer of the majority of the ink to the substrate 114, any residual ink and/or residual dampening fluid must be removed from the reimageable surface of the imaging member 110, preferably without scraping or wearing that surface. An air knife may be employed to remove residual dampening fluid. It is anticipated, however, that some amount of ink residue may remain. Removal of such remaining ink residue may be accomplished through use of some form of cleaning subsystem 170. The 714 application describes details of such a cleaning subsystem 170 including at least a first cleaning member such as a sticky or tacky member in physical contact with the reimageable surface of the imaging member 110, the sticky or tacky member removing residual ink and any remaining small amounts of surfactant compounds from the dampening fluid of the reimageable surface of the imaging member 110. The sticky or tacky member may then be brought into contact with a smooth roller to which residual ink may be transferred from the sticky or tacky member, the ink being subsequently stripped from the smooth roller by, for example, a doctor blade.

The 714 application details other mechanisms by which cleaning of the reimageable surface of the imaging member 110 may be facilitated. Regardless of the cleaning mechanism, however, cleaning of the residual ink and dampening fluid from the reimageable surface of the imaging member 110 is essential to preventing ghosting in the proposed system. Once cleaned, the reimageable surface of the imaging member 110 is again presented to the dampening fluid system 120 by which a fresh layer of dampening fluid is supplied to the reimageable surface of the imaging member 110, and the process is repeated.

Figure 2:
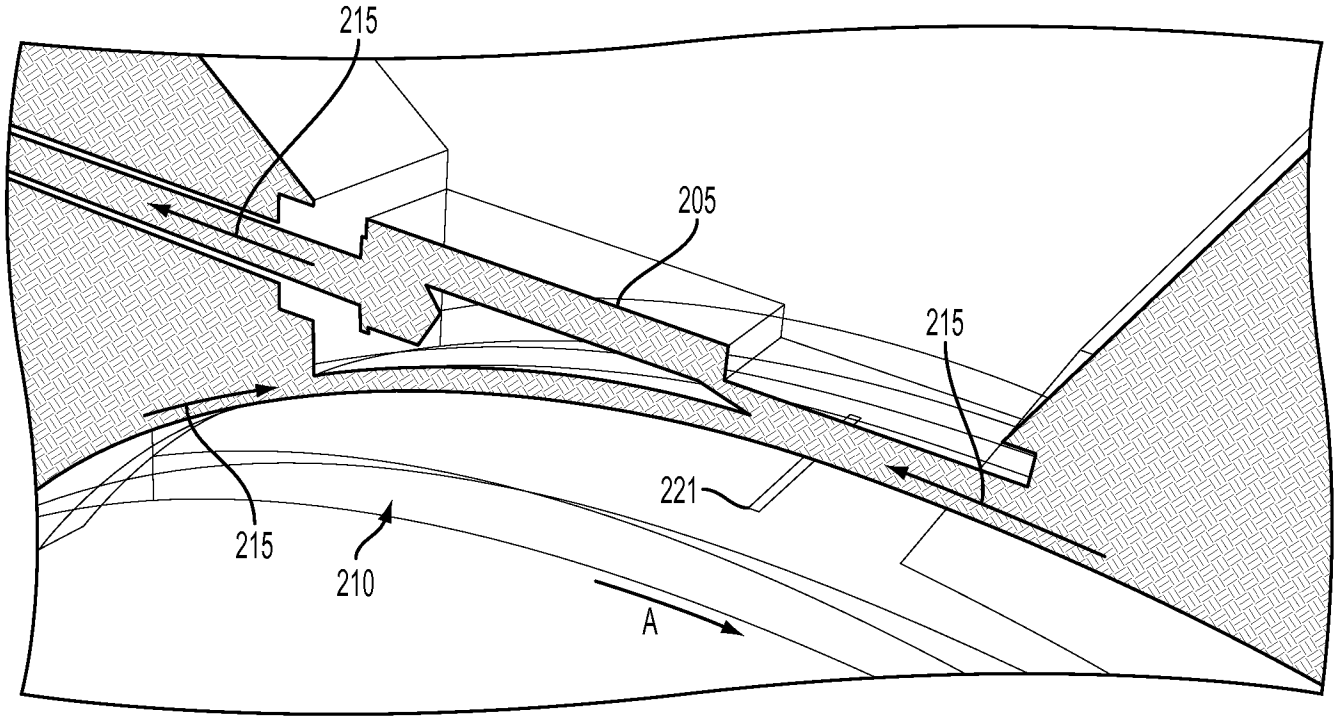
FIG. 2 RELATED ART
FIG. 2 shows a diagrammatical perspective cross-sectional view of a related art ink-based digital printing system dampening fluid recovery system.

An ink-based digital printing system including a related art dampening fluid recover system is shown in FIG. 2. In particular, FIG. 2 shows a diagrammatical perspective cross-sectional view of a related art ink-based digital printing system dampening fluid recovery system 205.

FIG. 2 shows the dampening fluid recovery system 205 positioned adjacent to a surface of an imaging member 210. The imaging member 210 rotates in a process direction "A" when printing. After a dampening fluid layer of, for example, less than 1 micron in thickness is applied to the surface of the imaging member 210, the dampening fluid is exposed to radiation emitted by a laser source according to image data. The laser causes select portions of dampening fluid to increase in temperature and evaporate, which results in production of dampening fluid vapor.

Related art dampening fluid removal systems such as removal system 205 are configured to include a structure generally defining a flow path through which air flows as a result of vacuum suction provided by a vacuum system (not shown). The flow path of 215 the related art removal system 205 includes is configured to guide vacuum air flow through the recovery system 205. For example, the system 205 includes a manifold body structure including a wall that is configured to face the imaging member 210 and form a sealed channel with the surface of the imaging member 210 at a dampening fluid evaporation location 221. In related art systems, the distance between the wall and imaging member surface is substantially the same at points before and after the evaporation location 221, with respect to a process direction A. As such, air flow across the surface of the imaging member 210 at and around the evaporation location 221.

Figure 3:
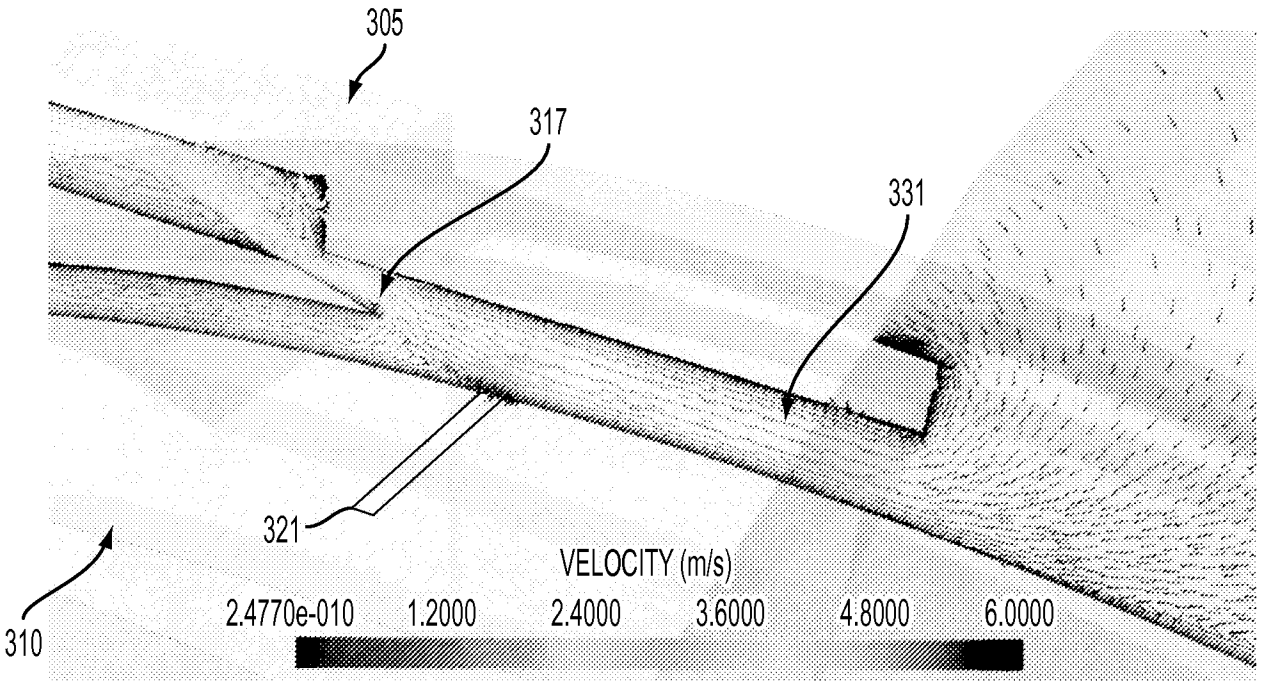
FIG. 3 RELATED ART
FIG. 3 shows a flow field for the related art dampening fluid recovery system of FIG. 2.

FIG. 3 shows an air flow field for the related art dampening fluid recovery system shown in FIG. 2. In particular, FIG. 3 shows a flow field for a process speed of 300 mm/sec, and a vacuum flow of 0.269 CFM. FIG. 3 shows a related art dampening fluid recovery system 305 positioned to face and form a seal with the imaging member 310 at least around the evaporation location 321. The related art recovery system 305 is configured to define vacuum air flow paths 331. As shown in FIG. 3, the air flow velocity vector field indicates a velocity that is substantially the same at positions before and after the dampening fluid evaporation location 321. The air velocity does increase at a portion of the flow channel 331, but that portion is located away and downstream from the evaporation location 321. It has been found that a substantial amount of vaporized dampening fluid tends to occur at and immediately following the evaporation location 321. Further, it has been found that corresponding portions of the translating imaging member 310 tend to decrease in temperature, enabling recondensation of vaporized dampening fluid onto the imaging member 310 surface.

Figure 4:
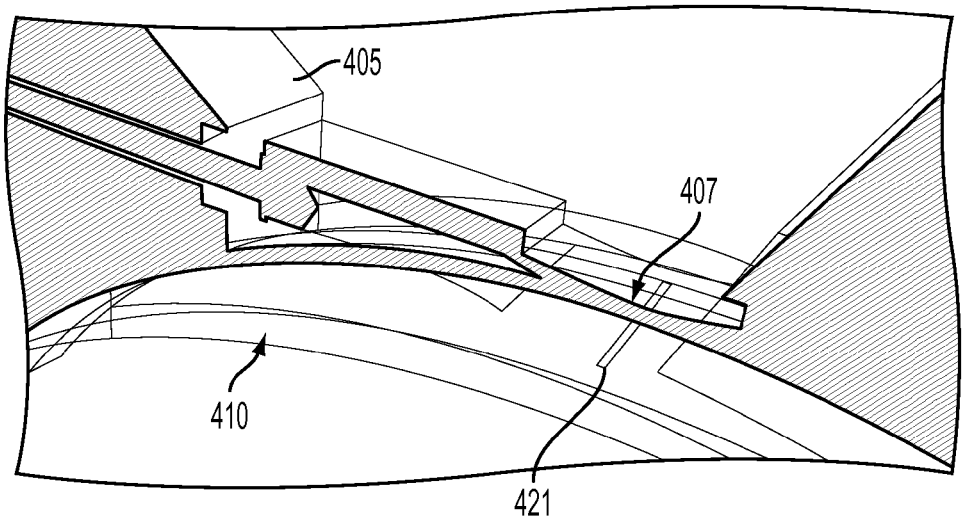
FIG. 4 shows a diagrammatical perspective cross-sectional view of an ink-based digital printing system dampening fluid recovery system in accordance with an exemplary embodiment.

FIG. 4 shows a diagrammatical perspective cross-sectional view of an ink-based digital printing system dampening fluid recovery system in accordance with an exemplary embodiment. The dampening fluid recovery system shown in FIG. 4 is configured to minimize a concentration of dampening fluid vapor at portions of the imaging member surface that have passed the dampening fluid evaporation location. In particular, a portion of the dampening fluid recovery system that forms a front seal at an evaporation location of the imaging member is shaped to reduce a flow area, thereby increasing a velocity of air flow passing the evaporation location region and reducing the amount of dampening fluid vapor above the translating imaging member during printing.

FIG. 4 shows a dampening fluid recovery system 405 positioned to form a seal over the surface of the imaging member 410. The recovery system 405 includes a contoured channel wall 407 disposed over a dampening fluid evaporation location 421. The recovery system 405 is configured to form a front seal at this location over the translating imaging member 410. Accordingly, vacuum air flow may be caused to pass the surface of the imaging member 410 near the fluid evaporation location at which dampening fluid vapor is generated during laser imaging. The contoured channel wall 407 forms a portion of the air flow channel through which vacuum air flow 417 is guided to the vacuum source (not shown). The contoured channel wall is formed to define a gap between the imaging member surface and the channel wall that is narrower at an evaporation location 421 than at points over the imaging member surface preceding the evaporation location, with respect to a process direction.

Figure 5:
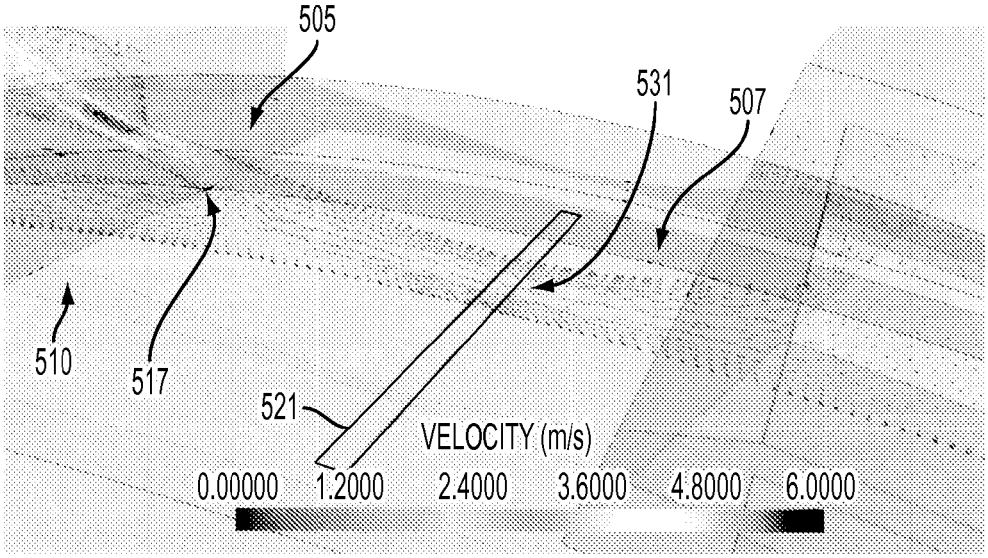
FIG. 5 shows an air flow field for the fluid recovery system of FIG. 4.

FIG. 5 shows an air flow field for the fluid recovery system of FIG. 4. FIG. 5 shows that the exemplary embodiment shown in FIG. 4 enables decreased cross-sectional area within the air flow channel at the evaporation location. Further, the exemplary embodiment including the contoured front seal channel wall and reduced flow area enables increased air flow speed at the evaporation location.

In particular, FIG. 5 shows a dampening fluid recovery system 505 having a contoured front seal channel wall 507. The recovery system 505 is configured to form a seal with a surface of an imaging member 510. The recovery system 505 is structured to define, alone or in cooperation with a surface of the imaging member 510, channels through which air flow 517 is guided. In particular, the system 505 is configured to form a front seal over the imaging member at an evaporation location 521. The system 505 includes the contoured channel wall 507, which define a front seal flow channel 531 that increases a flow velocity at and around the evaporation location 521.

Figure 6:
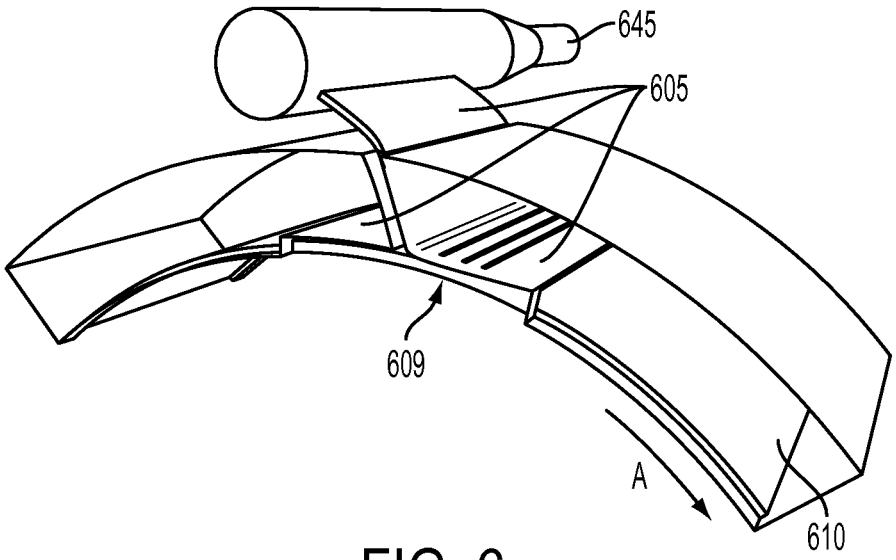
FIG. 6 shows a diagrammatical perspective cross-sectional view of a fluid recovery system in accordance with an exemplary embodiment.

FIG. 6 shows a dampening fluid recovery system in accordance with another exemplary embodiment. In particular, FIG. 6 shows a dampening fluid recovery system 605 that includes a manifold body. The manifold body includes a front seal portion 609 that forms a seal with a surface of an imaging member 610, which rotates in a process direction A during printing. The front seal portion 609 is disposed an evaporation location over the surface of the imaging member. The walls of the manifold body at the front seal portion 609 include a wall that faces the imaging member 610 surface, and is contoured wherein a gap defined by the wall and the imaging member 610 surface is narrower at and/or near the evaporation location. The front seal wall also forms a manifold inlet channel that extends to the vacuum source 645.

Figure 7:
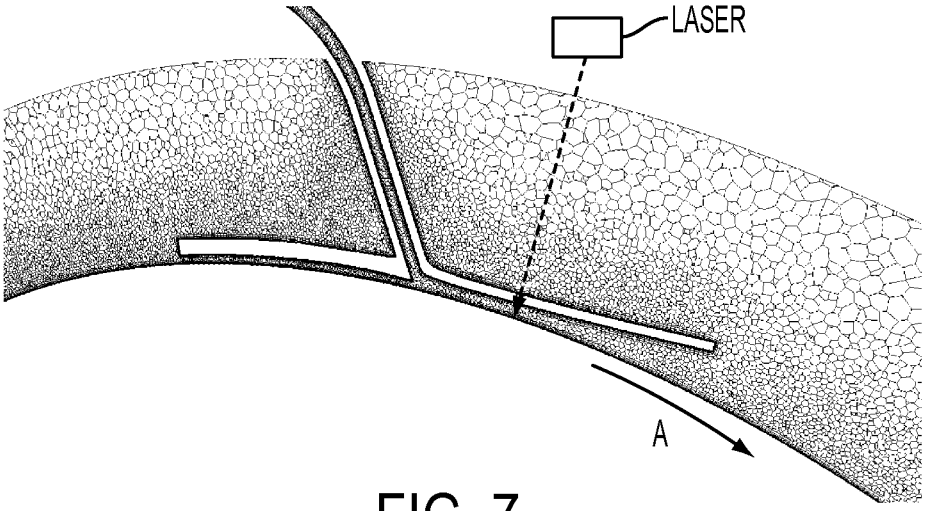
FIG. 7 shows a diagrammatical cross-sectional image of a fluid recovery system in accordance with an exemplary embodiment.

For example, FIG. 7 shows a diagrammatical cross-section view of the fluid recovery system of FIG. 6. The system includes a front seal manifold wall that is configured to define a channel with the imaging member surface that is narrower at and slightly preceding, with respect to a process direction "A," the evaporation location that corresponds to the laser irradiation location shown in FIG. 7. The front seal manifold wall of FIG. 7 extends away from the imaging member and toward a vacuum source (not shown), forming a vacuum manifold inlet channel with a rear seal manifold wall.

As shown in FIG. 7, it is preferred that the narrowest portion of the front seal channel that precedes the vacuum inlet channel be no less than 2 mm wide. It is preferred that a channel defined by the rear seal wall and the imaging member have a substantially continuous width, and a width of about 1 mm, for example.

Figure 8:
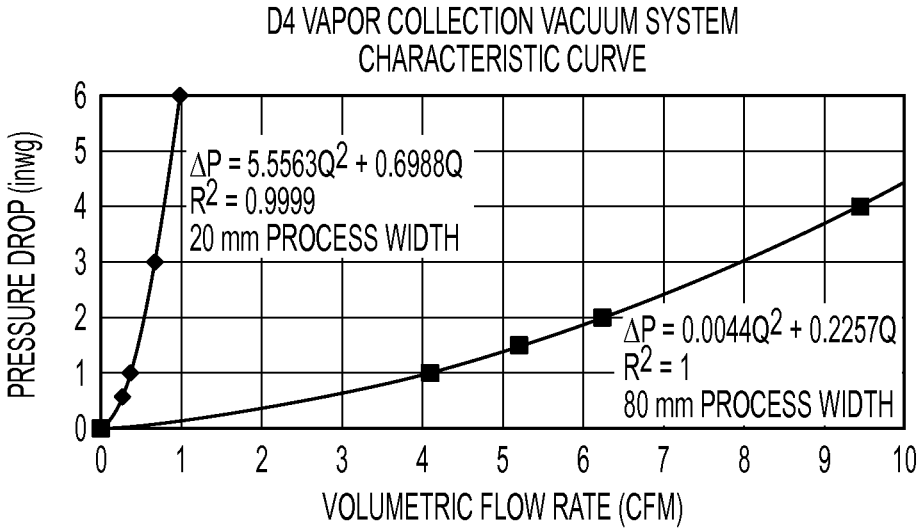
FIG. 8 is a graph showing exemplary flow characteristic curve for fluid recovery systems in accordance with embodiments.

FIG. 8 shows a comparison of a characteristic curve of a comparative design and a design in accordance with an exemplary embodiment. FIG. 8 shows that the embodiment shown in FIGS. 6-7 provides substantially high and desirable air flow at lower operating pressure, which enables use of lower cost fan(s) or blower(s) in the vacuum system design. As process width increase, it is important to maintain air flow uniformity across the process width to allow for uniform removal of dampening fluid at the dampening fluid evaporation location of the imaging member. As such, it is preferred that an area ratio of inlet channel to the manifold cross-section be maintained below 0.8.

Figure 9:
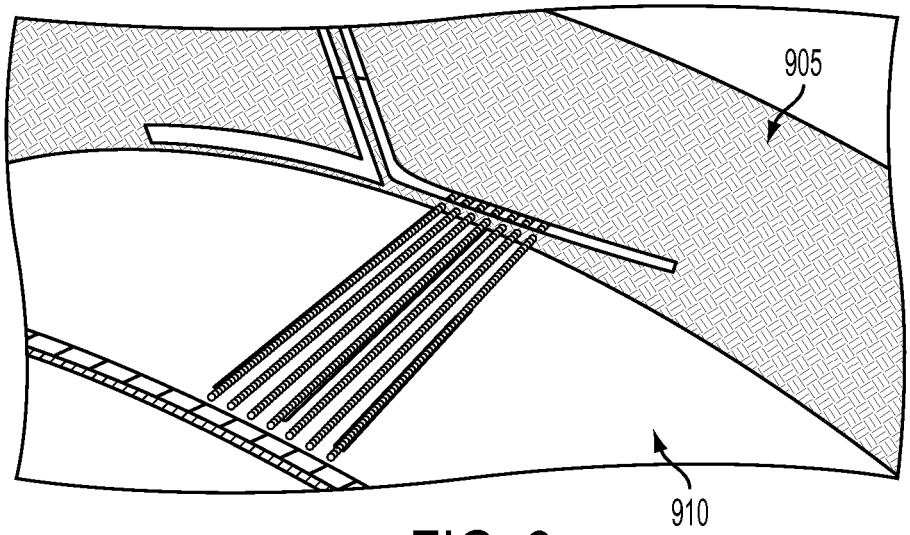
FIG. 9 shows probe lines for velocity magnitude plots.

FIG. 9 shows a diagrammatical perspective cross-section of the air flow channel defined by the dampening fluid recovery system 905, and the imaging member 905. FIG. 9 shows probe lines where flow velocity magnitude is plotted as a function of location. The probe lines are numbered in sequence from 6 to 12.

Figure 10:
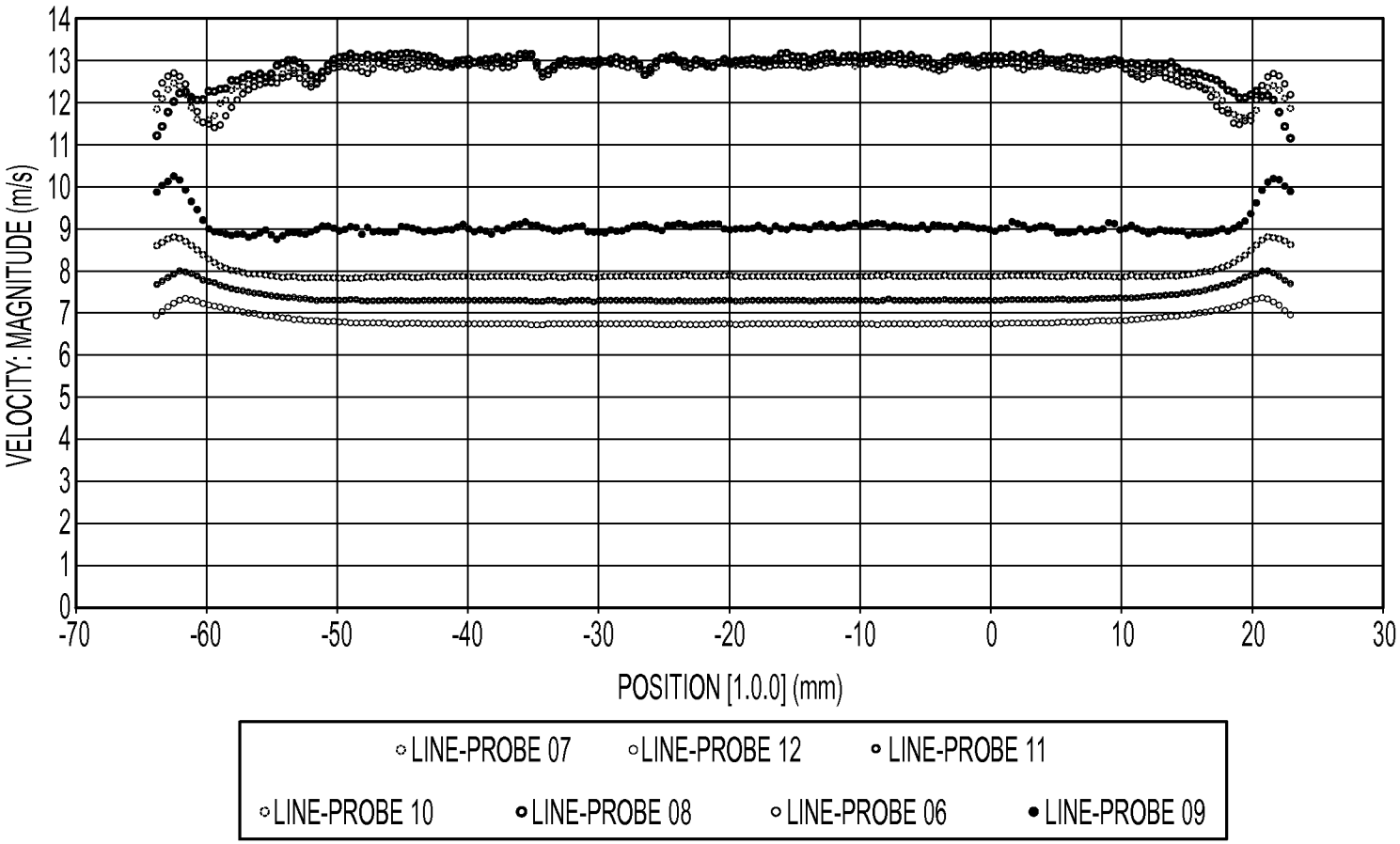
FIG. 10 is graph showing air velocity magnitude and uniformity.

FIG. 10 shows the air flow velocity magnitude distribution along each of the probe lines shown in FIG. 9. The graph shows the air velocity at 0.5 mm above the imaging member 610 of FIG. 6. The variation of air speed across the process direction within the printing region is maintained to within +/−5%. This distribution provides uniform dampening fluid vapor removal within the printing region. The non-uniformity at the ends is the result of the ends of the imaging member and the step down of the rotating drum carrying the imaging member surface.

Figure 11:
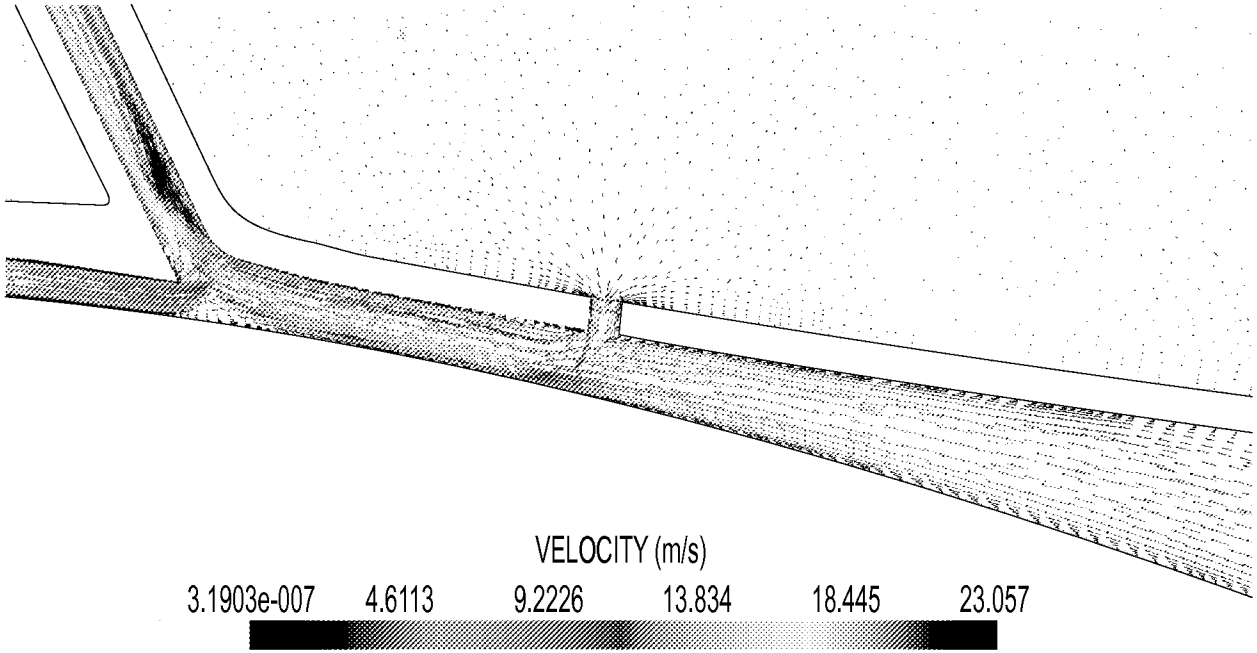
FIG. 11 shows an air flow field for a dampening fluid recovery system in accordance with an embodiment.

FIG. 11 shows an air flow velocity field for a process speed of 600 mm/sec and 6.23 CFM at 2.0 inwg using a dampening fluid recovery system in accordance with the embodiment shown in FIGS. 6-7. The manifold design has been found to reduce relative humidity in the dampening fluid evaporation region by a factor of 10, even with the two-fold increase in evaporation rate due to process speed. The increase in flow rate and the shaped contour of the front seal upper surface wall of the manifold structure allows for air flow to penetrate well within the concentration boundary layer to within 15 microns of the imaging member surface. Because D4 has a thickness of about 0.5 microns, disturbance of such dampening fluid layers is not expected.

Increasing a process speed increases an evaporation rate. For example, a flow rate of 9.44 CFM may give a maximum relative humidity of about 68%, which is satisfactory for preventing condensation. Further reduction in humidity is possible by increasing the flow rate.

Figure 12:
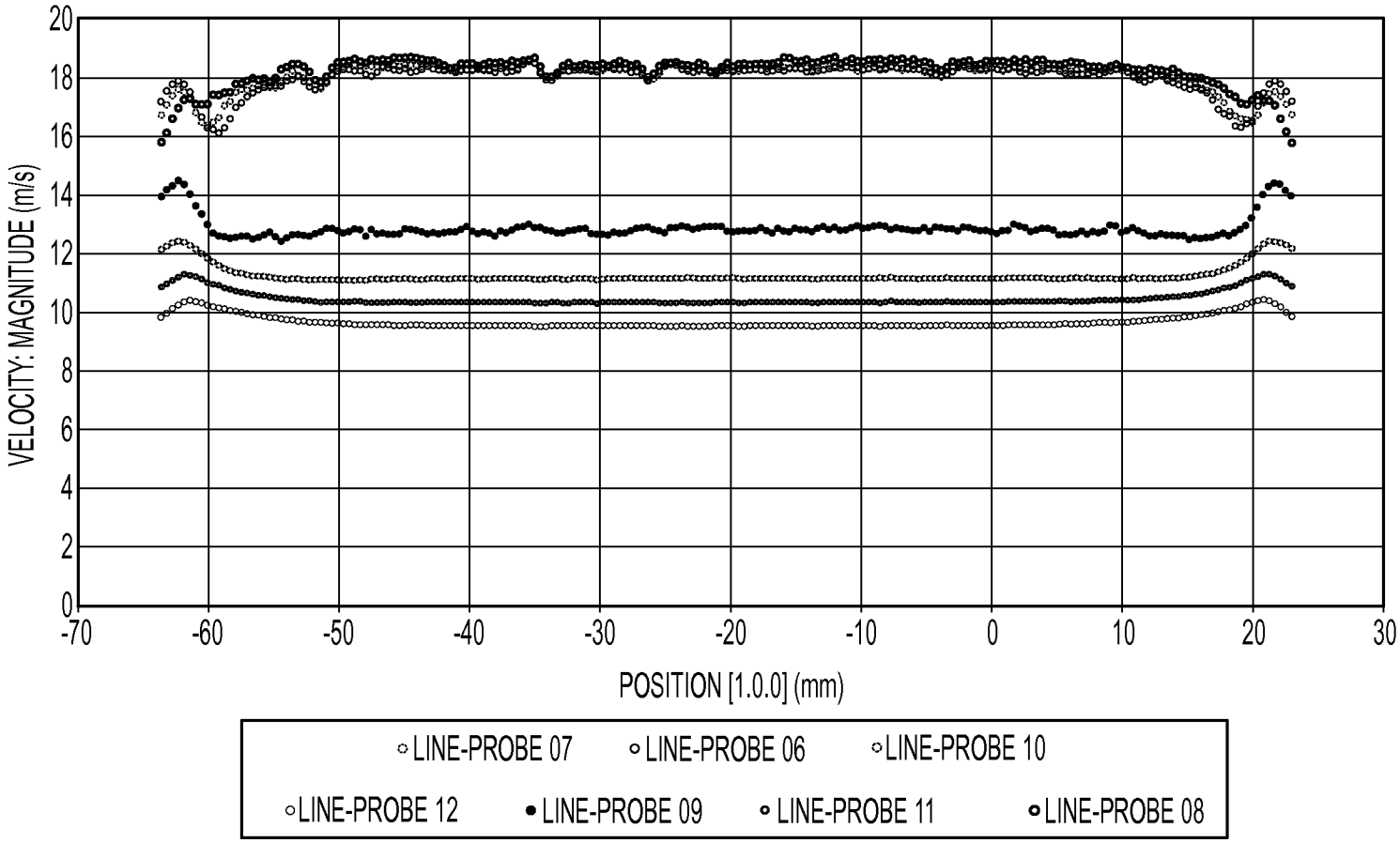
FIG. 12 is a graph showing air velocity magnitude and uniformity.

Flow uniformity findings are shown in FIG. 12. The line probe location as are the same as those shown in FIG. 8.

It will be appreciated that the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. An ink-based digital printing dampening fluid recovery system, comprising:

a central imaging member having an imaging surface;

a dampening fluid metering system, the metering system being configured to apply dampening fluid to the imaging surface;

a dampening fluid recovery system for removing dampening fluid vapor from the imaging member surface, the dampening fluid recovery system comprising:

a seal manifold having a front seal portion, the front seal portion having an upper wall facing the imaging surface, the upper wall being configured to define an air flow channel with the imaging surface;

wherein the upper wall being contoured to form a narrow gap between the upper wall and the imaging surface at an evaporation location;

wherein the narrow gap at the evaporation location decreases cross-sectional area and increases air flow within the air flow channel at the evaporation location;

wherein at the narrow gap distance is less than distance between the upper wall and the imaging surface at locations interposing the evaporation location and a vacuum inlet channel of the seal manifold.

2. The system of claim 1, wherein the dampening fluid is applied to form a dampening fluid layer having a thickness of less than 1 micron.

3. The system of claim 2, wherein the thickness of the dampening fluid layer is about 0.5 microns thick.

4. The system of claim 2, comprising:

a laser imaging system, the laser imaging system being configured to irradiate the dampening fluid layer according to digital image data.

5. The system of claim 1, comprising:

a vacuum source.

6. The system of claim 1, wherein the dampening fluid comprises D4.

7. The system of claim 1, wherein the digital imaging system is configured to print at process speeds of about 300 mm/sec.

8. The system of claim 1, the seal manifold body further comprising:

a rear portion, the rear portion having a rear portion upper wall, the rear portion upper wall and the surface of the imaging member defining an upstream flow channel, the upstream flow channel being located upstream of the evaporation location, with respect to a process direction.

9. The system of claim 8, the comprising the rear portion upper wall and the upper wall of the front portion of the seal manifold defining the outlet, the outlet extending away from the imaging member surface, the outlet, the upstream air flow channel and the air channel that contacts the imaging member surface at the evaporation location being in communication.

10. The system of claim 9, comprising the rear upper wall and the imaging member surface defining a gap having a thickness of 1 mm or less.

11. The system of claim 10, wherein the gap thickness is continuous along a length of the rear flow channel.

12. A dampening fluid recovery apparatus for use with an ink-based digital printing system, the digital printing system having a central imaging member having an imaging surface, a dampening fluid metering system, the metering system being configured to apply dampening fluid to the imaging surface; and a laser imaging system configured for irradiating the applied dampening fluid according to digital image data, the apparatus comprising:

a seal manifold, the seal manifold having a front seal portion, the front seal portion having an upper wall facing the imaging surface;

wherein the upper wall being configured to define an air flow channel with the imaging surface;

wherein the upper wall being contoured to form a narrow gap between the upper wall and the imaging surface at an evaporation location;

wherein the narrow gap at the evaporation location decreases cross-sectional area and increases air flow within the air flow channel at the evaporation location;

wherein at the narrow gap distance is less than distance between the upper wall and the imaging surface at locations interposing the evaporation location and a vacuum inlet channel of the seal manifold.

13. The apparatus of claim 12, wherein the dampening fluid is applied to form a dampening fluid layer having a thickness of less than 1 micron.

14. The apparatus of claim 13, wherein the thickness of the dampening fluid layer is about 0.5 microns thick.

15. The apparatus of claim 12, comprising:

a vacuum source.

16. The apparatus of claim 12, wherein the dampening fluid comprises D4.

17. The apparatus of claim 12, wherein the digital imaging system is configured to print at process speeds at least 300 mm/sec.

18. The apparatus of claim 12, the seal manifold body further comprising:

a rear portion, the rear portion having a rear portion upper wall, the rear portion upper wall and the surface of the imaging member defining an upstream flow channel, the upstream flow channel being located upstream of the evaporation location, with respect to a process direction, the rear portion upper wall and the upper wall of the front portion of the seal manifold defining the outlet, the outlet extending away from the imaging member surface, the outlet, the upstream air flow channel and the air channel that contacts the imaging member surface at the evaporation location being in communication.

19. The apparatus of claim 18, comprising the rear upper wall and the imaging member surface defining a gap having a thickness of 1 mm or less.

20. The apparatus of claim 18, wherein the gap thickness is continuous along a length of the rear flow channel.

* * * * *